United States Patent [19]

Kastrup

[11] Patent Number: 4,550,672

[45] Date of Patent: Nov. 5, 1985

[54] THREAD-HOLDING APPARATUS FOR BUTTONHOLE MACHINE

[75] Inventor: Eberhard Kastrup, Bielefeld, Fed. Rep. of Germany

[73] Assignee: Durkoppwerke GmbH, Bielefeld, Fed. Rep. of Germany

[21] Appl. No.: 607,198

[22] Filed: May 4, 1984

[30] Foreign Application Priority Data

May 4, 1983 [DE] Fed. Rep. of Germany ..... 8313114

[51] Int. Cl.[4] ..... D05B 65/02; D05B 53/00

[52] U.S. Cl. ..... 112/293; 112/253

[58] Field of Search ..... 112/293, 294, 295, 253, 112/286

[56] References Cited

U.S. PATENT DOCUMENTS

| | | | |
|---|---|---|---|
| 1,538,752 | 5/1925 | Seely | 112/293 |
| 2,450,043 | 9/1948 | Haas | 112/293 |
| 3,494,316 | 2/1970 | Ross | 112/253 X |
| 4,364,319 | 12/1982 | Niehaus et al. | 112/253 X |

FOREIGN PATENT DOCUMENTS

| | | | |
|---|---|---|---|
| 2053559 | 5/1972 | Fed. Rep. of Germany | 112/253 |
| 894657 | 4/1962 | United Kingdom | 112/253 |
| 2006283 | 5/1979 | United Kingdom | 112/253 |

*Primary Examiner*—H. Hampton Hunter

*Attorney, Agent, or Firm*—Karl F. Ross; Herbert Dubno

[57] ABSTRACT

A thread-holding device is used with a standard buttonhole machine having a support head, a stitching needle for a needle thread displaceably mounted on the support head, and a blade for cutting the needle thread after a stitching operation and forming thereon a free end extending laterally from the needle. The thread-holding device comprises a support plate pivoted on the head, and a thread clip having a pair of jaws displaceable between a closed position engaging each other for holding the thread and an open position for releasing it. An actuator on the support plate and carrying the thread clip can move same vertically between an upper position spaced laterally relatively far from the needle and a lower position laterally relatively close to the needle. A control unit is connected to the clip and to the actuator for moving the clip from the open to the closed position while moving it from the upper to the lower position after a stitching operation to grasp the free end of the cut thread adjacent the needle. On moving back up into the upper position, the thread is pulled out of the clip, which is however aligned with the second, normally right-hand, side of the buttonhole so that this free end will be stitched right into the buttonhole.

10 Claims, 6 Drawing Figures

THREAD-HOLDING APPARATUS FOR BUTTONHOLE MACHINE

FIELD OF THE INVENTION

The present invention relates to a buttonhole machine. More particularly this invention concerns a thread-holding device for such a machine.

BACKGROUND OF THE INVENTION

As described in German Pat. No. 830,286 assigned to The Singer Manufacturing Company and filed with a claim to a U.S. priority date of Nov. 14, 1947, a buttonhole machine that makes double-chain stitch button holes of different lengths has a pivotal needle guide and a pivotal goods gripper that move synchronously. Such a machine is used with a device that holds the end of the severed needle thread between sewing operations, so that this thread end is not pulled back out of the needle.

This thread-cutting and -holding device is mounted on the presser foot and serves to cut the needle thread near the workpiece at the end of a stitching operation and to hold the free end until the start of the next stitching operation. This end is left hanging out, however, so that not only is it unsightly, but it creates a possibility of raveling.

Another buttonhole machine is known having a thread clip that is secured on the blade that cuts the buttonhole. The free end of the needle thread is held by this device until the start of the following stitching operation. Such an arrangement is only usable on buttonholing systems where the actual buttonhole is cut after the right and left hand sides of the buttonhole and the tack stitching at each end are complete, and in this arrangement also once the needle thread is released by the clip it is left dangling.

OBJECTS OF THE INVENTION

It is therefore an object of the present invention to provide an improved thread-holding device for a buttonhole machine.

Another object is the provision of such a thread-holding device for a buttonhole machine which overcomes the above-given disadvantages, that is which allows the free end of the needle thread from the first stitching operation of the buttonhole to be stitched into the second row of stitching, typically the right-hand side of the buttonhole.

A further object is to provide a thread-holding device which can be used in a buttonholing system regardless of whether the goods are slit before or after the two sides of the buttonhole are stitched, either zig-zag or double chain.

SUMMARY OF THE INVENTION

The thread-holding device according to this invention is used with a standard buttonhole machine having a support head, a stitching needle for a needle thread displaceably mounted on the support head, and a blade for cutting the needle thread after a stitching operation and forming thereon a free end extending laterally from the needle. The thread-holding device comprises a support plate pivoted on the head, and a thread clip having a pair of jaws displaceable between a closed position engaging each other for holding the thread and an open position for releasing it. An actuator on the support plate and carrying the thread clip can move same vertically between an upper position spaced laterally relatively far from the needle and a lower position laterally relatively close to the needle. A control unit is connected to the clip and to the actuator for moving the clip from the open to the closed position while moving it from the upper to the lower position after a stitching operation to grasp the free end of the cut thread adjacent the needle. On moving back up into the upper position, the thread is pulled out of the clip, which is however aligned with the second, normally right-hand, side of the buttonhole so that this free end will be stitched right into the buttonhole.

The actuator according to this invention also includes a guide defining for the clip a path of travel having a relatively long and straight upper portion extending from the upper position and a relatively short and less upright lower portion extending laterally therefrom to the lower position. Thus on displacement from the upper to the lower position the clip moves mainly vertically and only moves laterally at the end of its vertical travel. The actuator pivots the clip in the lower portion of its travel. In addition the actuator has a spring operatively engaged between the clip and the support plate and urging the clip into the upper position, and stops operatively engageable between the clip and the buttonhole machine for limiting lateral pivoting of the clip. This is a linear actuator, normally a solenoid or a fluid-powered cylinder or ram. A pneumatic cylinder is ideal.

According to another feature of this invention one of the clip jaws is relatively stationary on the actuator and the other clip jaw is pivotal thereon and the clip includes a spring urging the jaws together into the closed position of the clip. The actuator has a nonstraight guide on the plate, a follower riding on the guide, and mainly lever links connected between the clip and the follower for pivoting the clip on the actuator at the end of its vertical travel in the lower portion of its travel path. The control unit includes an actuating element on the support plate, and levers connected between the actuating element and the pivotal jaw for separating the jaws and displacing the clip into the open position on downward displacement of the clip along the lower portion of its path.

The lever is pivoted on the actuator and has one end engageable with the actuating element and an opposite end engageable with the pivotal jaw. A spring is engaged between the plate and the lever for urging same out of engagement with the pivotal jaw, and means is provided for pivoting the plate on the head between a position with the lever engageable with the actuating element on descent of the clip and a position unengageable therewith on ascent of the clip.

A spring is braced between the plate and the head. Thus the entire system operates mechanically and simply.

DESCRIPTION OF THE DRAWING

The above and other features and advantages will become more readily apparent from the following, in which.

SPECIFIC DESCRIPTION

Figure 1:
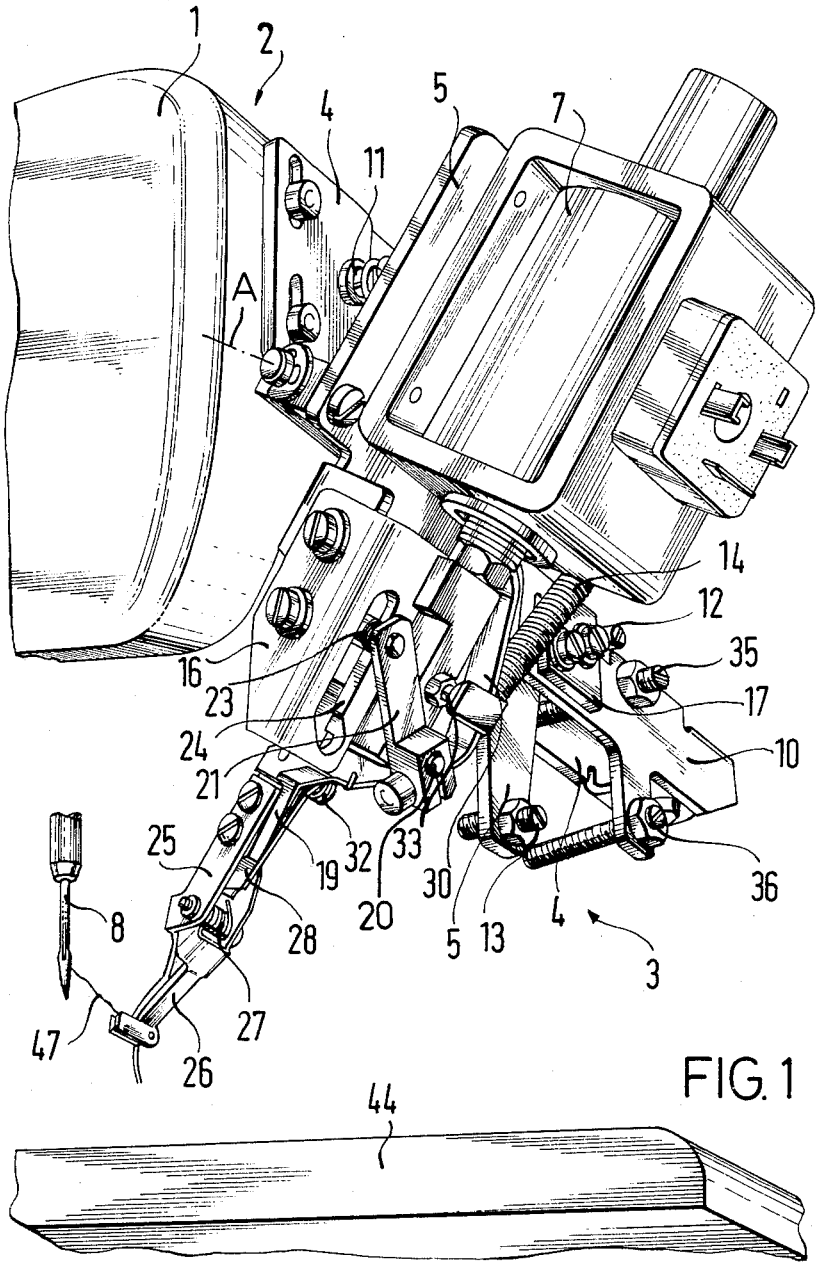
FIG. 1 is a perspective view of the apparatus according to this invention.
Figure 2:
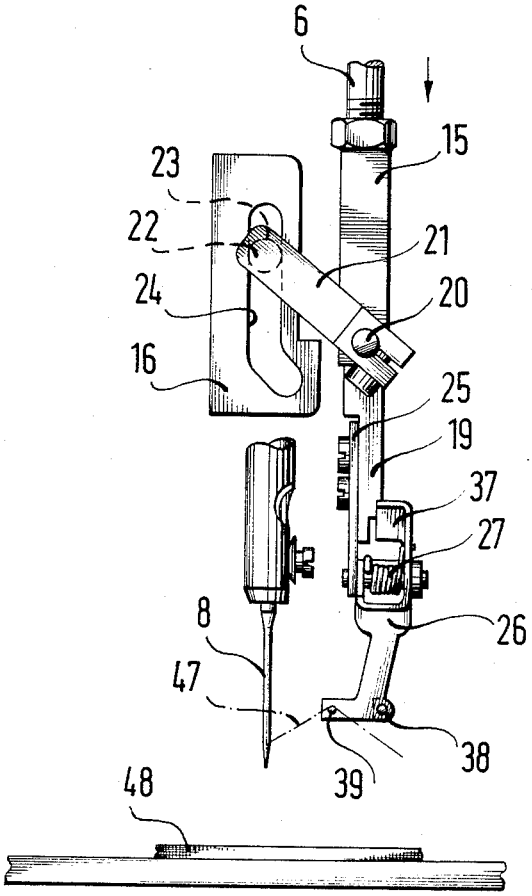
FIG. 2 is a front view of a portion of the apparatus in a position with the held thread end being moved down so it can be sewn into the right side of the buttonhole and with the downwardly moving thread clip not yet pivoted.

As seen in FIG. 1 a buttonhole machine 2 has an arm 1 provided with a thread-holding device 3 according to this invention. This device 3 has a support plate 4 bolted to the arm 1 and a carrier plate 5 pivotal about an axis A relative to the plate 4, with a spring 11 urging the upper regions of these two plates 4 and 5 apart and stops 12 and 13 serving to define the ends of this pivoting. A linear-type solenoid actuator 7 has a core rod 6 which is normally pulled upward by a spring 14, but which moves down when the solenoid 7 is electrically energized. The rod 6 carries a support block 15 that cannot rotate on this rod 6 and on which is pivoted a pin 20 carrying a support element 19 in turn carrying a thread clip 9. One end of the pin 20 carries a lever or actuating arm 21 whose outer end is provided with a roller 23. The axis A is horizontal and normally perpendicular to the stitching direction and the pin 20 is centered on an axis lying in a plane perpendicular to the axis A and parallel to the stitching direction, so that the clip 9 can be pivoted both in and transverse to this stitching direction, which is perpendicular to the plane of the view in FIGS. 2 and 3 and parallel thereto in FIGS. 4 and 5.

Figure 4:
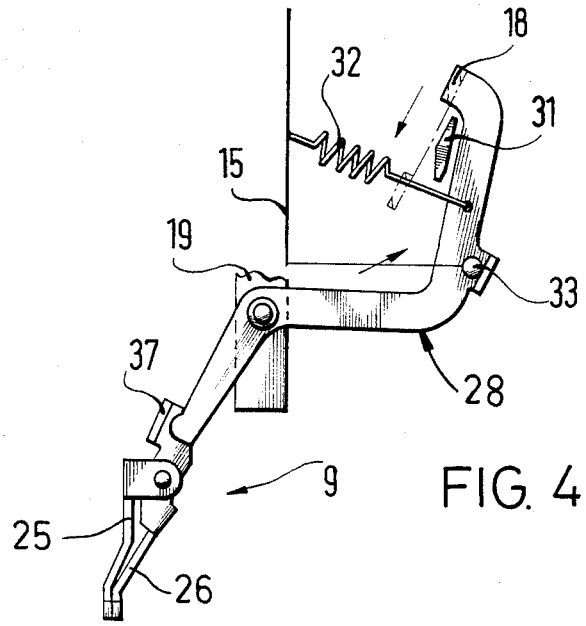
FIG. 4 is a simplified side view of the closed clip.

The clip 9 is constituted by a stationary jaw 25 fixed on the lower end of the element 19 and a movable jaw 26 pivotal thereon and urged by a spring 27 into the closed position of FIG. 4. The lower end of the jaw 26 is provided with a tensioning pin 38 and a smaller diameter pin 39. The projecting end of the tensioning pin 38 is immediately adjacent the lower end of the jaw 25 whereas the projecting end of the pin 39 engages in a recess in the lower region of the jaw 25. The outer ends of the pins 38 and 39 are directed toward the jaw 25.

Figure 5:
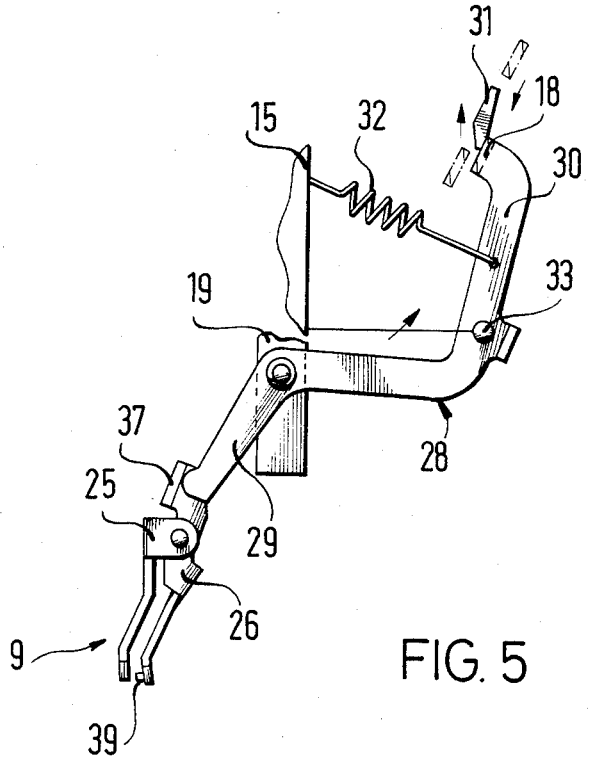
FIG. 5 is a simplified side view of the open clip.
Figure 6:
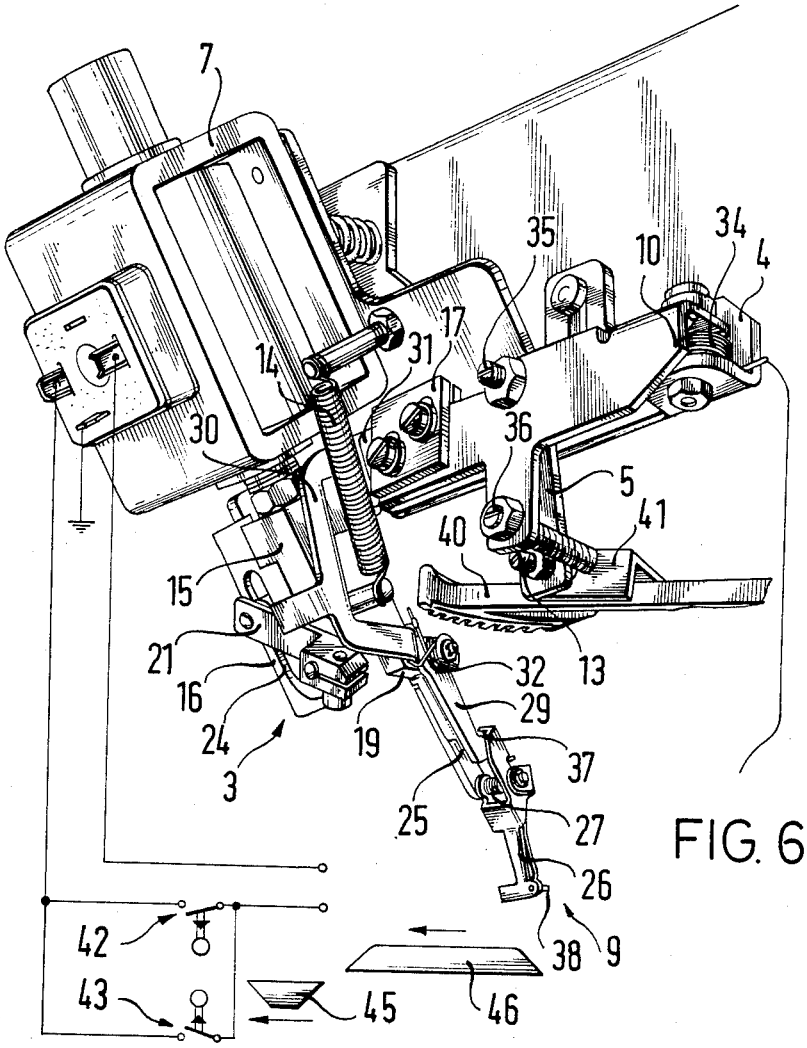
FIG. 6 is a partly diagrammatic and perspective view of the apparatus, but showing the elements that control pivoting of the thread clip.

The upper end of the movable jaw 26 has a tab 37 engageable by the lower end 29 of a lever 28 pivoted on the support element 19. A spring 32 hooked between the block 15 and the upper end 30 of the lever 28 urges it out of engagement with the tab 37 and into engagement with a stop or abutment 33 fixed on the block 15 and shown schematically in FIGS. 4 and 5. The upper end or arm 30 of the lever 28 has a tab 18 engageable as will be described below with an actuating element 31 to pivot the lever 28 clockwise as seen in FIGS. 4 and 5 to open the clip 9.

Figure 3:
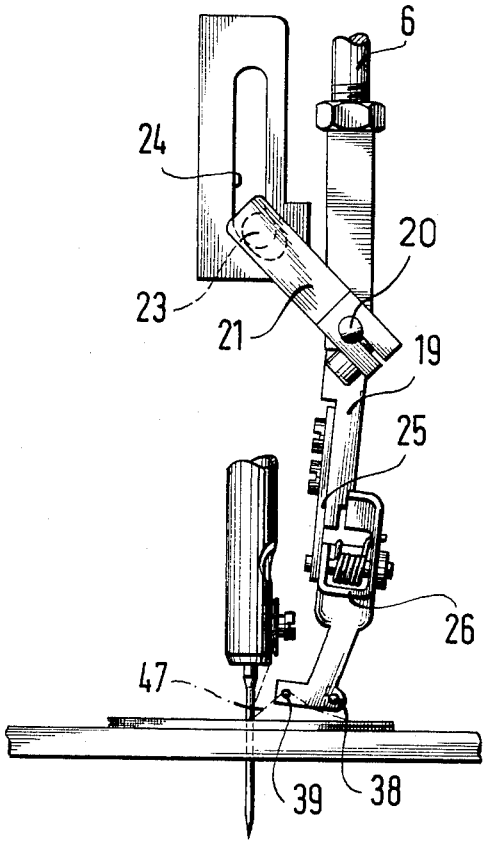
FIG. 3 is a front view like FIG. 2 but showing the apparatus after the clip has pivoted and the thread end is being sewn into the right buttonhole side.

An L-section plate 16 fixed on the plate 5 is formed with an elongated nonstraight guide slot 24 in which engages the roller 23. The upper portion of this slot 24 extends parallel to the displacement direction of the element 19, but the lower end is angled relative thereto so that as the element 19 is moved down with the lever 21 by the actuator 7 the lever 21 is pivoted somewhat, thereby pivoting the entire clip 19 clockwise as can be seen in FIG. 3. Such pivoting 3 moves the clip 9 toward the needle 8 of the machine 1.

A lever 10 is pivoted on the plate 4 also and urged away from it by a spring 34. Adjustable stops 35 and 36 constituted like the stops 12 and 13 as screws and lock nuts are provided to limit this pivoting. A plate 17 adjustably secured to this lever 10 is formed with the actuating element 31 that can engage the tab 18.

The buttonhole machine 1 has a sector gear 40 that drives the rotatably mounted needle rod guide and that carries an angle 41 engageable in a predetermined position with the stops 13 and 36. In addition adjustable cams 45 and 46 are provided to actuate switches 42 and 43 that are connected in parallel to the solenoid 7 so that when closed same is actuated and moves the rod 6 with the clamp 9 down. The cam 45 is adjustable depending on how long the buttonhole is.

The apparatus described above functions as follows:

Once the left side of the buttonhole is complete a blade underneath the stitch plate 44 cuts the needle thread 47 in the standard manner, leaving this thread engaged through the goods 48. At the same time the cam 45 underneath this plate 44 engages the switch 43 to energize the solenoid 7. The rod 6 moves down, taking the clip 9 with it, and this clip 9 is pivoted inward toward the needle 8 as the roller 23 moves to the lower end of its guide slot 24.

The sector gear 40 and the angle 41 carried on it are in a left-hand end position relative to the left side of the buttonhole. As a result the angle 41 does not touch the stop 13 so that the support plate 5 and the thread clip 9 are arrested in their left-hand end position, relative to the left buttonhole side, by the stop 12. In addition this angle 41 does not touch the stop 36 so that the lever 10 is in the end position defined by the stop 35, so that the descending tab 18 slides past the element 31 as illustrated in FIG. 5 and the lever 28 is pivoted slightly clockwise, engages the tab 37, and pivots the jaw 26 counterclockwise to open the clip 9.

As the open clip 9 swings toward the needle 8, the needle thread 47 comes between the jaws 25 and 26. Once the tab 18 has moved down past the actuating element 31, however, the clip 9 snaps shut on the thread 47, holding it firmly. At about this time the current to the solenoid 6 is cut, and the clip 9 moves up as also indicated in FIG. 5. The edges of the actuating element 31 are beveled so that during such upward movement the lever 28 is not pivoted clockwise and the clip 9 remains closed. Thus the clip 9 moves back up again, pulling the cut filament end out of the goods 47.

The sector gear 40 then pivots the needle guide around to position the needle at the right end of the right side of the buttonhole to be finished. Synchronously therewith the pivotally mounted gripper moves in standard fashion into the same end position. This rotation of the sector gear 40 presses the angle 41 against the ends of the stops 13 and 36, pivoting the support plate 5 and the clip 9 into the position corresponding to the right side of the buttonhole. In addition the lever 10 is moved into such a position that the tab 18 is positioned to move on the left past the actuating element 31 when the clip 9 descends.

When a new stitching operation is initiated the buttonhole machine 1 moves the plate 44 forward, so that the cam 46 carried on it actuates the switch 42 to again drop the clip 9. As before, the clip 9 pivots in toward the needle 8 at the lower end of its descent, but this time the clip 9 remains closed as it passes to the left of the actuating element 31. This action lays the thread end 47 along the line where the machine 1 will now form a line of zig-zag stitches that will completely cover and enclose this end, even in very thin fabric. Thus the end will be completely incorporated in the right buttonhole side, preventing raveling and making a neat job.

During this stitching of the right buttonhole side the filament 47 is slowly pulled out of the clip and in fact is completely pulled therefrom and incorporated in the right buttonhole side. Once the machine 1 comes to the end of this second side of the buttonhole, thereby completing it, the cam 46 moves off the switch 42 and the solenoid 7 is deenergized, and the clip 7 moves back up into its starting position. The cycle can then be repeated.

The apparatus of this invention automatically catches the free end of the needle thread after the first side, here the left side although it could technically also be the right side, of the buttonhole is done. The machine holds this end in position so when the second side of the buttonhole, here the right side is stitched, this end is completely stitched in. The result is a very neat and strong buttonhole.

I claim:

1. In combination with a buttonhole machine having:

a support head;

a stitching needle for a needle thread displaceably mounted on the support head; and means for cutting the needle thread after a stitching operation and forming thereon a free end extending laterally from the needle; a thread-holding device comprising:

a support plate pivoted on the head;

a thread clip having a pair of jaws displaceable between a closed position engaging each other for holding the thread and an open position for releasing it;

means including an actuator on the support plate and carrying the thread clip for moving same vertically between an upper position spaced laterally relatively far from the needle and a lower position laterally relatively close to the needle; and control means connected to the clip and to the actuator for moving the clip from the open to the closed position while moving it from the upper to the lower position after a stitching operation to grasp the free end of the cut thread adjacent the needle.

2. The combination defined in claim 1 wherein the actuator means includes guide means defining for the clip a path of travel having a relatively long and straight upper portion extending from the upper position and a relatively short and less upright lower portion extending laterally therefrom to the lower position, whereby on displacement from the upper to the lower position the clip moves mainly vertically and only moves laterally at the end of its vertical travel.

3. The combination defined in claim 2 wherein the actuator pivots the clip in the lower portion of its travel.

4. The combination defined in claim 3 wherein the actuator means includes a spring operatively engaged between the clip and the support plate and urging the clip into the upper position.

5. The combination defined in claim 3 wherein the actuator means includes stops operatively engageable between the clip and the buttonhole machine for limiting lateral pivoting of the clip.

6. The combination defined in claim 3 wherein the actuator is a linear actuator.

7. The combination defined in claim 6 wherein the linear actuator is a solenoid.

8. The combination defined in claim 3 wherein one of the clip jaws is relatively stationary on the actuator and the other clip jaw is pivotal thereon and the clip includes a spring urging the jaws together into the closed position of the clip, the actuator means including:

a nonstraight guide on the plate, a follower riding on the guide, and link means connected between the clip and the follower for pivoting the clip on the actuator at the end of its vertical travel in the lower portion of its travel path, the control means including:

an actuating element on the support plate, and lever means connected between the actuating element and the pivotal jaw for separating the jaws and displacing the clip into the open position on downward displacement of the clip along the lower portion of its path.

9. The combination defined in claim 8 wherein the lever means includes a lever pivoted on the actuator and having one end engageable with the actuating element and an opposite end engageable with the pivotal jaw, a spring engaged between the plate and the lever for urging same out of engagement with the pivotal jaw, and means for pivoting the plate on the head between a position with the lever engageable with the actuating element on descent of the clip and a position unengageable therewith on ascent of the clip.

10. The combination defined in claim 9, further comprising a spring braced between the plate and the head.

* * * * *